US012274952B1

(12) United States Patent
Ng

(10) Patent No.: US 12,274,952 B1
(45) Date of Patent: Apr. 15, 2025

(54) ASSEMBLED MODEL KIT

(71) Applicant: Yanni Ng, Hong Kong (CN)

(72) Inventor: Yanni Ng, Hong Kong (CN)

( * ) Notice: Subject to any disclaimer, the term of this patent is extended or adjusted under 35 U.S.C. 154(b) by 0 days.

(21) Appl. No.: 18/928,588

(22) Filed: Oct. 28, 2024

(51) Int. Cl.
*A63H 3/46* (2006.01)
*A63H 33/00* (2006.01)

(52) U.S. Cl.
CPC ..... *A63H 3/46* (2013.01); *A63H 33/003* (2013.01)

(58) Field of Classification Search
CPC ... A63H 3/00; A63H 3/16; A63H 3/46; A63H 33/033
See application file for complete search history.

(56) References Cited

U.S. PATENT DOCUMENTS 9,067,147 B1 * 6/2015 Woodhouse ..... A63H 3/46
9,511,301 B2 * 12/2016 Fukuchi ..... A63H 3/46
9,737,824 B2 * 8/2017 Ejima ..... A63H 3/003
10,500,514 B2 * 12/2019 Baker ..... A63H 3/48
11,154,790 B2 * 10/2021 Chen ..... A63H 3/46
11,566,659 B2 * 1/2023 Moffatt ..... A63H 3/46
2007/0060011 A1 * 3/2007 Daftari ..... A63H 3/46 446/97
2010/0216367 A1 * 8/2010 Kasahara ..... A63H 3/16 446/97
2012/0142247 A1 * 6/2012 Hara ..... A63H 33/003 446/72
2023/0381679 A1 * 11/2023 Baker ..... A63H 3/48

* cited by examiner

*Primary Examiner* — John A Ricci

(57) ABSTRACT

The invention discloses a rapidly pre-assembled model product, which is formed by mutually sleeving and assembling a trunk model, a head model, an arm model and a leg model; The head model is arranged on the top of the trunk model; The arm model includes a left arm model and a right arm model, wherein the left arm model is arranged on the left side of the top of the trunk model, and the right arm model is arranged on the right side of the top of the trunk model; The leg model includes a left leg model and a right leg model, wherein the left leg model is arranged on the left side of the bottom of the trunk model, and the right leg model is arranged on the right side of the bottom of the trunk model. The figure model of the invention is formed by mutually sleeving and assembling a trunk model, a head model, an arm model and a leg model, thus canceling the splicing form of the existing model adopting a small block structure, and through the pre-assembled modules, the modules are assembled and spliced through corresponding connecting structures, so as to make the whole model product assembled and spliced more conveniently and quickly.

9 Claims, 21 Drawing Sheets

ASSEMBLED MODEL KIT

FIELD

The present invention relates to the field of models, in particular to a rapidly pre-assembled model product.

BACKGROUND

Models and toy products on the market are usually only finished products and assembled products in the traditional sense. The assembled toys include but are not limited to: traditional water enclosure, building block assembly and other implementation methods.

For some character product models, the existing model assembly method is to use block structure for arc splicing, that is, the character models are divided into small block structures one by one. When this kind of block structure is divided into small pieces, the style outline of some structures cannot be intuitively seen; When splicing such assembled products, it will be very difficult to operate. The existing assembly model is a connection structure of insert pieces, so the joints of the assembled model can't move, and then the model is not flexible enough to play and operate.

SUMMARY

It is an object of the present invention to provide a quickly pre-assembled model product to solve the problems raised in the above-described background art.

In order to achieve the above object, the present invention provides the following technical scheme: a rapidly pre-assembled model product is formed by mutually sleeving and assembling a trunk model, a head model, an arm model, a leg model and a model hand;

The head model is arranged at the top of the trunk model, a ball-head connecting mechanism is arranged between the connection of the head model and the trunk model, and the head model and the trunk model realize rotational adjustment through the ball-head connecting mechanism;

The arm model includes a left arm model and a right arm model, wherein the left arm model is arranged on the left side of the top of the trunk model, and the right arm model is arranged on the right side of the top of the trunk model; A first round rod connecting mechanism and a second round rod connecting mechanism are respectively provided at the connecting positions between the left arm model and the right arm model and the trunk model; the connecting positions between the left arm model and the right arm model and the trunk model are respectively provided with the first round rod connecting mechanism and the second round rod connecting mechanism; The left arm model and the right arm model are respectively rotated 360° in the vertical direction at both sides of the top of the trunk model through the first round rod connecting mechanism and the second round rod connecting mechanism;

The leg model includes a left leg model and a right leg model, wherein the left leg model is arranged on the left side of the bottom of the trunk model, and the right leg model is arranged on the right side of the bottom of the trunk model; The left leg model, the right leg model and the trunk model are rotated vertically at 360° at both sides of the bottom of the trunk model through a ball-head connecting mechanism;

The wrist end part of the model hand is provided with a groove, and the groove and the arm model realize rotational adjustment through a ball-head connecting mechanism.

Preferably, the trunk model includes a model chest and a model waist and abdomen, and the top of the model chest is provided with a ball-bowl-shaped groove for connecting the head model; Both sides of the bottom of the waist and abdomen of the model are provided with ball-head connecting mechanisms respectively used for connecting the left leg model and the right leg model, and the front side of the chest of the model is provided with a front chest baffle plate, wherein the bottom of the waist and abdomen of the model is rotatably interspersed and connected with the top of the waist and abdomen of the model, and the two sides of the bottom of the waist and abdomen of the model are provided with a ball-head connecting mechanism respectively.

Preferably, the head model comprises:

A model head, wherein both sides of the model head are provided with connecting pieces, one end of the connecting piece far away from the model head is sleeved with a model ear, and the bottom of the model head is fixedly connected with a group of ball-head connecting mechanisms;

The connecting piece comprises a connecting column and a connecting insert block, a plurality of the connecting column and the connecting insert blocks are symmetrically arranged on both sides of the model head along the horizontal and transverse directions, and the connecting insert blocks are arranged below the connecting column;

A model neck, wherein a ball-bowl structure is arranged at the top of the model neck, and the ball-bowl structure is sleeved with a ball-head connecting mechanism at the bottom of the model head through the ball-bowl structure; The bottom of the model neck is fixedly connected with a ball-head connecting mechanism used for connecting the trunk model, and the ball-head connecting mechanism at the bottom of the model neck is rotatably interspersed and connected with a ball-bowl groove at the top of the chest of the model. The ball-head connecting mechanism at the bottom of the model neck is connected with the ball-bowl groove at the top of the chest of the model.

Preferably, the left arm model comprises:

A left boom model, wherein the right side of the left boom model is used for connecting the first round rod connecting mechanism, and the right side of the left boom model is provided with a left chimney model;

A left forearm model, a top portion of the left forearm model is hinged with a bottom portion of the left forearm model, and a rotation angle of the left forearm model and the left forearm model is 0° to 150°.

Preferably, the first round rod connecting mechanism includes a first connecting disk, and the first connecting disk is disposed on the right side of the left boom model. The side of the first connecting disk far away from the left big arm model is provided with a first connecting insert column, and the first connecting insert column is connected with the left side of the chest of the model in a rotational and interspersed manner, and the first connecting insert column is connected with the left side of the chest of the model.

Preferably, the right arm model comprises:

A right boom model, wherein the left side of the right boom model is used for connecting the second round rod connecting mechanism, and the right side of the right boom model is provided with a right chimney model;

A right forearm model, a top portion of the right forearm model is hinged with a bottom portion of the right forearm model, and a rotation angle of the right forearm model and the right forearm model is 0° to 150°.

Preferably, the second round rod connecting mechanism includes a second connecting disk, the second connecting disk is provided on the left side of the right big arm model, a side of the second connecting disk away from the right big arm model is provided with a second connecting insert column, and the second connecting insert column is rotatably interspersed and connected with the right side of the chest of the model.

Preferably, the left leg model comprises:

A left thigh model, wherein the right side of the top of the left thigh model is provided with a first ball-bowl sleeve for connecting with a ball-head connecting mechanism at the left side of the waist and abdomen bottom of the model;

A left calf model, the top portion of the left calf model is hinged with the bottom portion of the left thigh model, and the rotation angle of the left calf model and the left thigh model along the horizontal longitudinal direction ranges from −90° to 90°;

A left foot model, wherein the left foot model is sleeved at the bottom of the left calf model, and a horizontal and horizontal rotation angle range between the left foot model and the left calf model is −70° to 70°; The top of the left foot model is hinged with a left foot collar, and the rotation angle of the left foot collar along the vertical direction is 0° to 30°.

Preferably, the right leg model comprises:

A right thigh model, wherein the left side of the top of the right thigh model is provided with a second ball-bowl sleeve for connecting with a ball-head connecting mechanism at the right side of the waist and abdomen bottom of the model;

A right calf model, the top portion of the right calf model is hinged with the bottom portion of the right thigh model, and the angle of rotation of the right calf model and the right thigh model along the horizontal longitudinal direction ranges from −90° to 90°;

A right foot model, wherein the right foot model is sleeved at the bottom of the right calf model, and a horizontal and horizontal rotation angle range between the right foot model and the right calf model is −70° to 70°; The top of the right foot model is hinged with a right foot collar, and the rotation angle of the right foot collar along the vertical direction is 0° to 30°.

Preferably, the ball-head connection mechanism comprises:

A connecting hemisphere, wherein a connecting pile is arranged at the top of the connecting hemisphere, and the connecting pile is used for fixing the ball-head connecting mechanism and other components; One side of the middle part of the connecting hemisphere is provided with a splicing column, one side of the bottom part of the connecting pile is provided with a connecting port, and the inner wall of the top end of the connecting port is provided with an elastic plate;

An assembly hemisphere, wherein one side of the assembly hemisphere is provided with a splicing groove, the splicing column is interspersed and connected with the splicing groove, and the top of the assembly hemisphere is provided with an assembly column; The assembly column is arranged in the connection port, the top end of the assembly column is provided with a placement groove, and the elastic plate is interspersed and connected with the placement groove.

The technical effects and advantages of the invention are as follows:

(1) The figure model of the invention is formed by mutually sleeving and assembling a trunk model, a head model, an arm model and a leg model, thus canceling the splicing form of the existing model adopting small block structure; Through the pre-assembled modules, each module is assembled and spliced through the corresponding connection structure, so that the whole model product is assembled and spliced more conveniently and quickly; The corresponding definition of each module is also determined by the composition of the module, which not only facilitates the identification of each module, but also further reduces the difficulty of product assembly;

(2) The head model and the trunk model of the invention are connected through a ball-head connecting mechanism, so that the head model can realize rotational adjustment around the trunk model; The arm model and the trunk model are connected by a round bar connecting mechanism, so that the arm model can rotate and adjust around the trunk model, and the leg model and the trunk model are also connected by a ball head connecting mechanism, so that the leg model can also rotate around the trunk model. Through the connection setting, the limb part of the model can flexibly adjust the rotation operation, so that the model can set diversified shapes according to the hobby of the player, so that the model product can be more flexible and diverse in playing operation.

Figure 1:
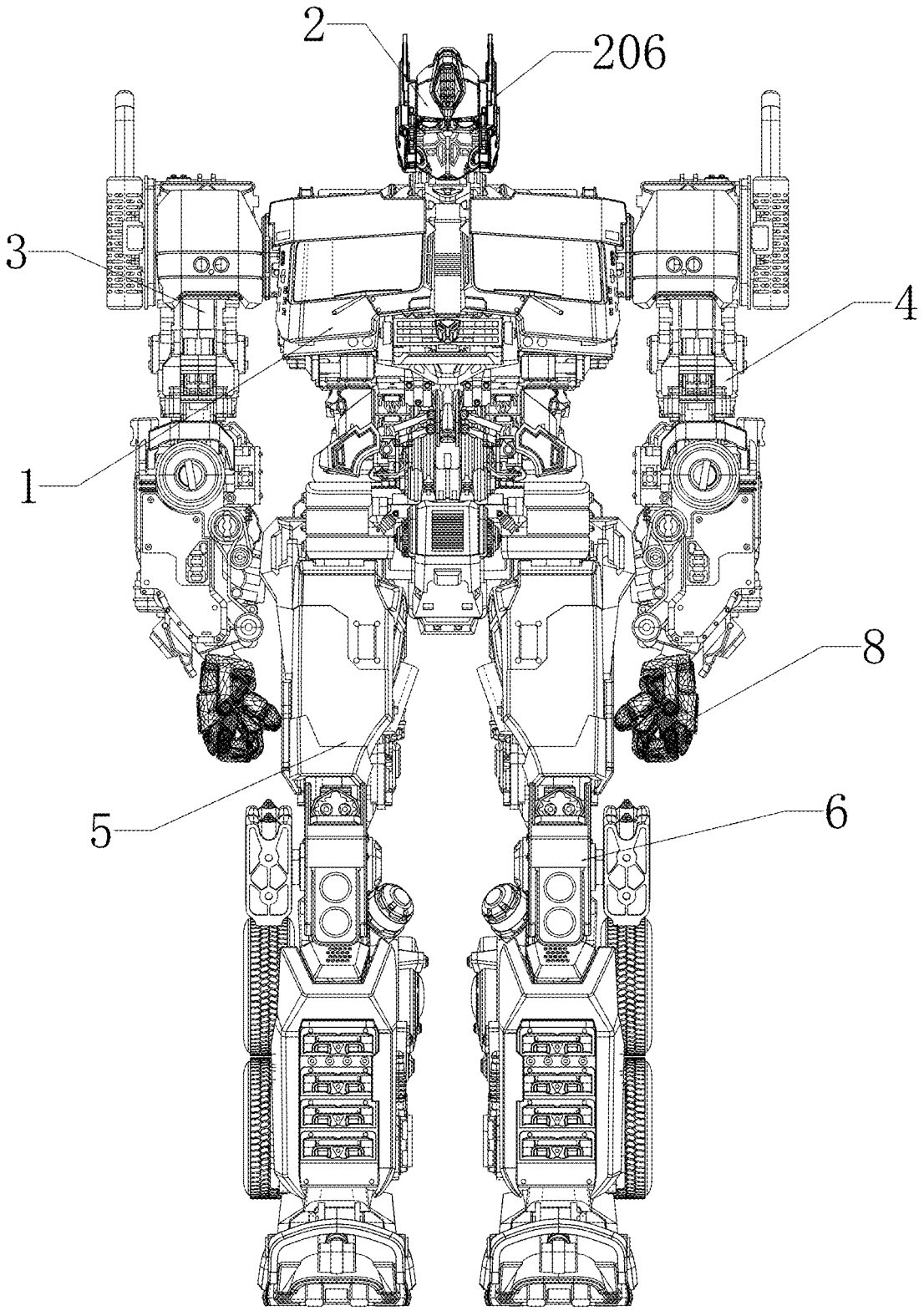
FIG. 1 is a front view of the entire structure of the present invention.
Figure 2:
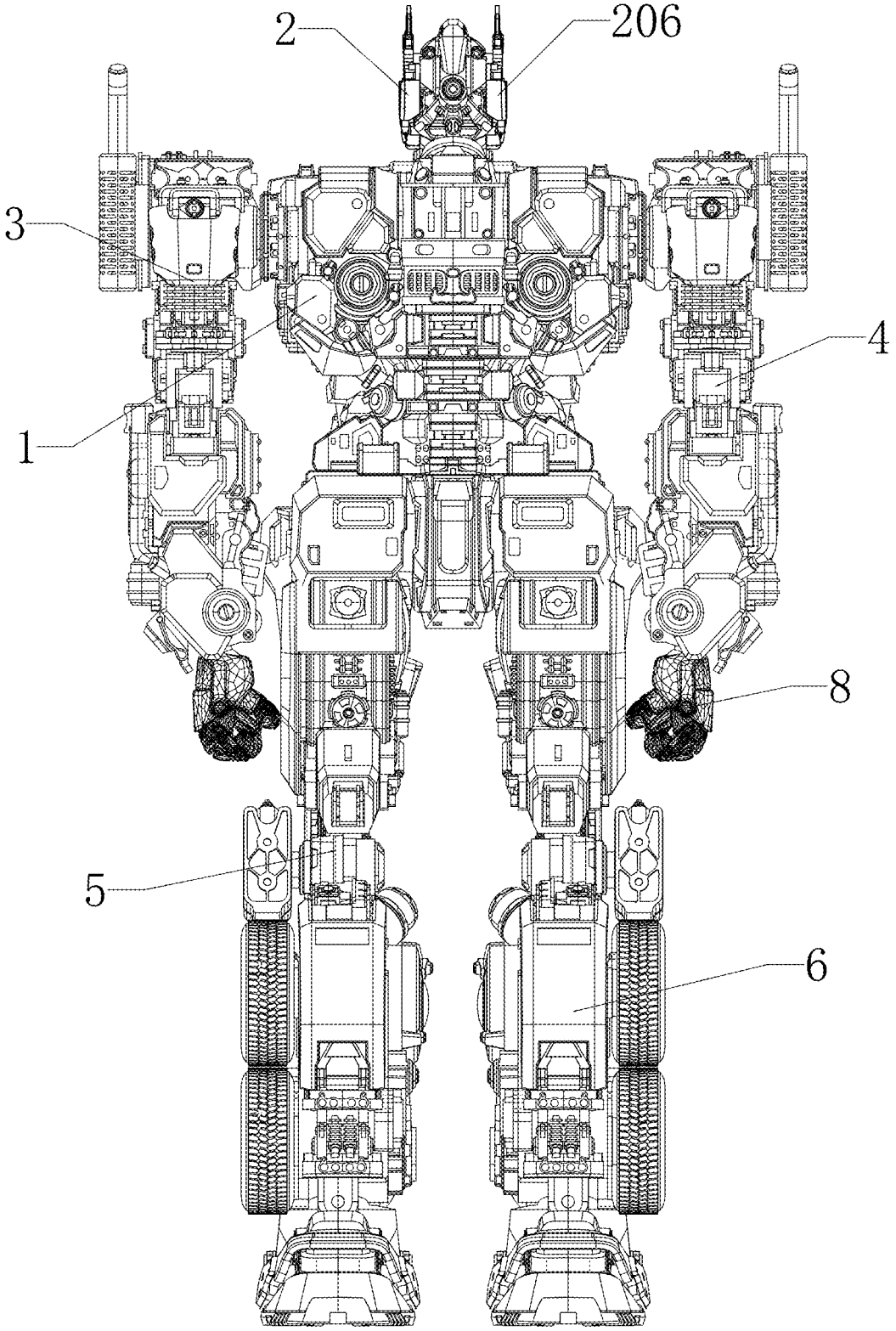
FIG. 2 is a rear view of the entire structure of the present invention.
Figure 3:
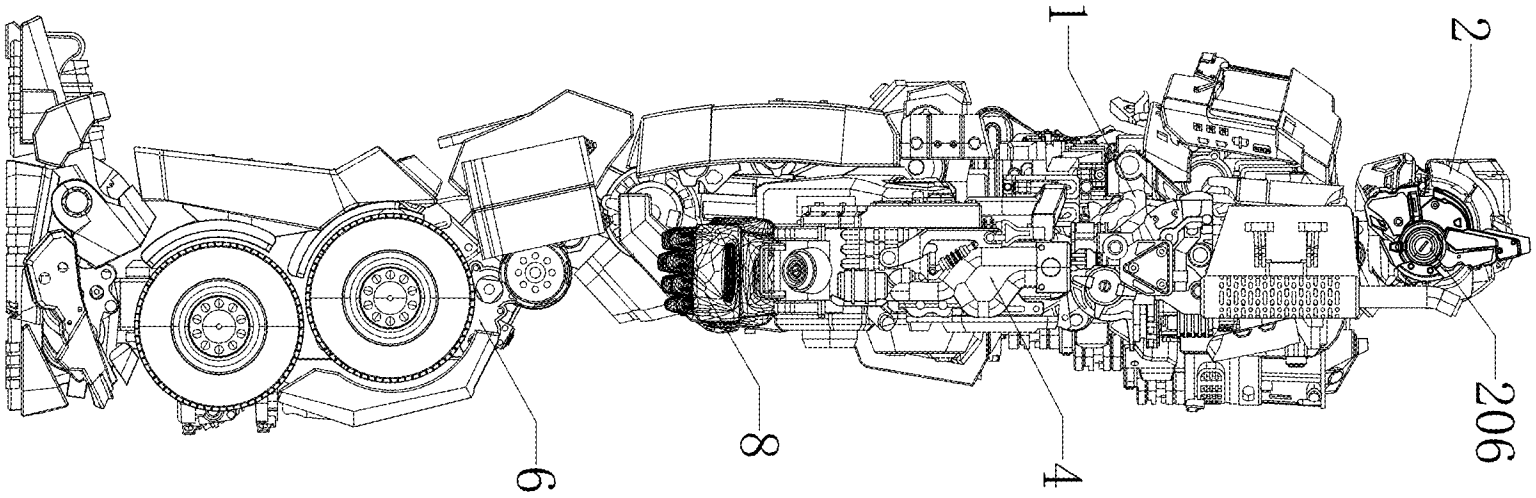
FIG. 3 is a right side view of the entire structure of the present invention.
Figure 4:
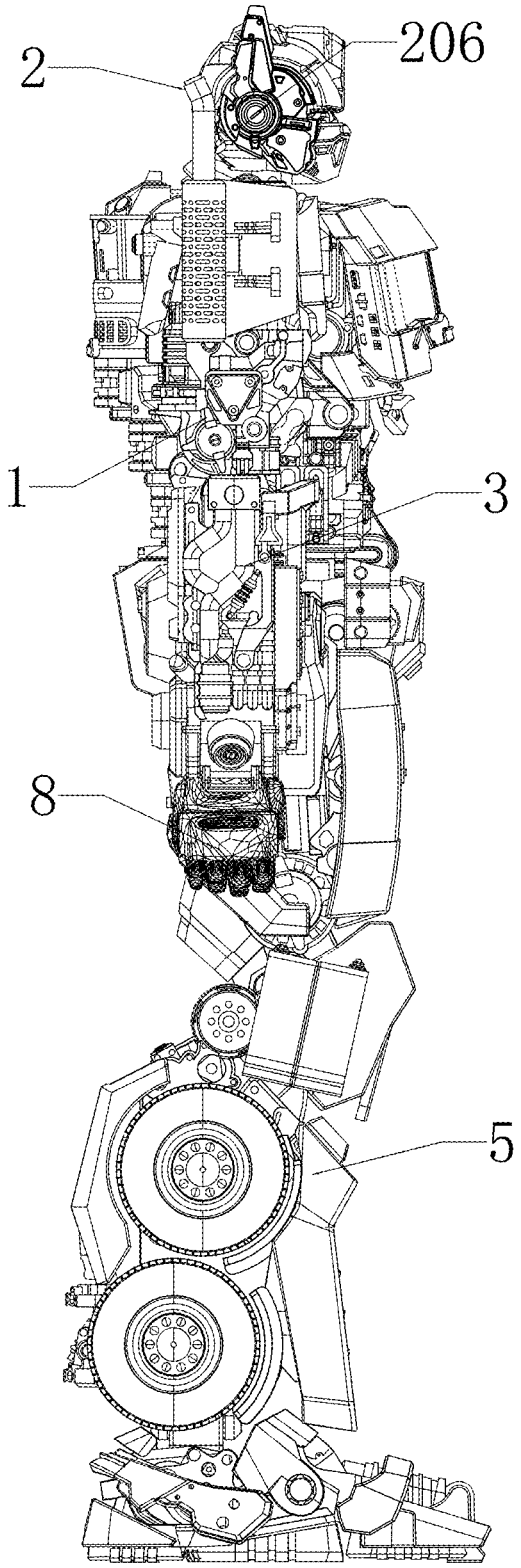
FIG. 4 is a left side view of the entire structure of the present invention.
Figure 5:
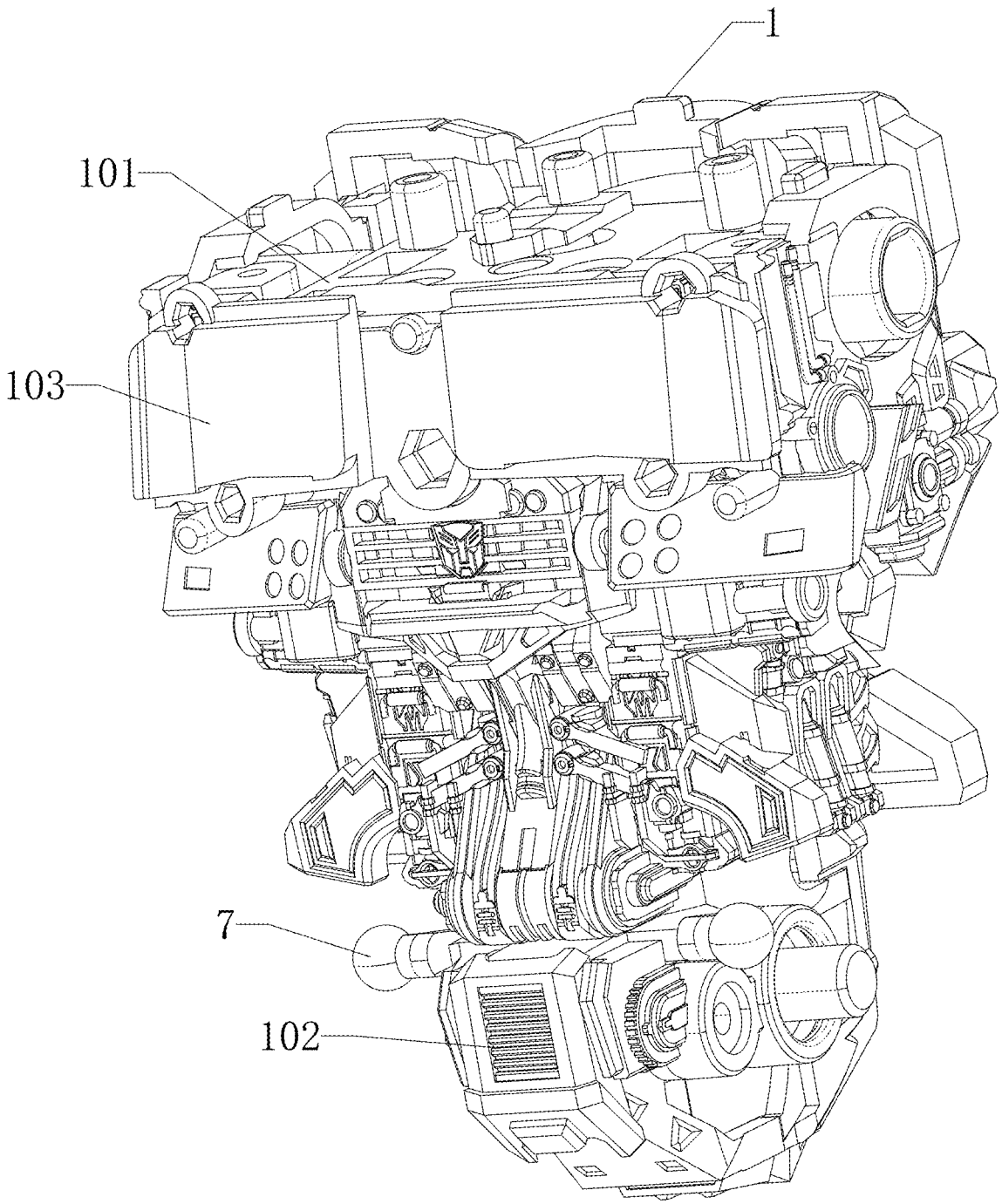
FIG. 5 is a schematic diagram of the overall structure of the trunk model according to the present invention.
Figure 6:
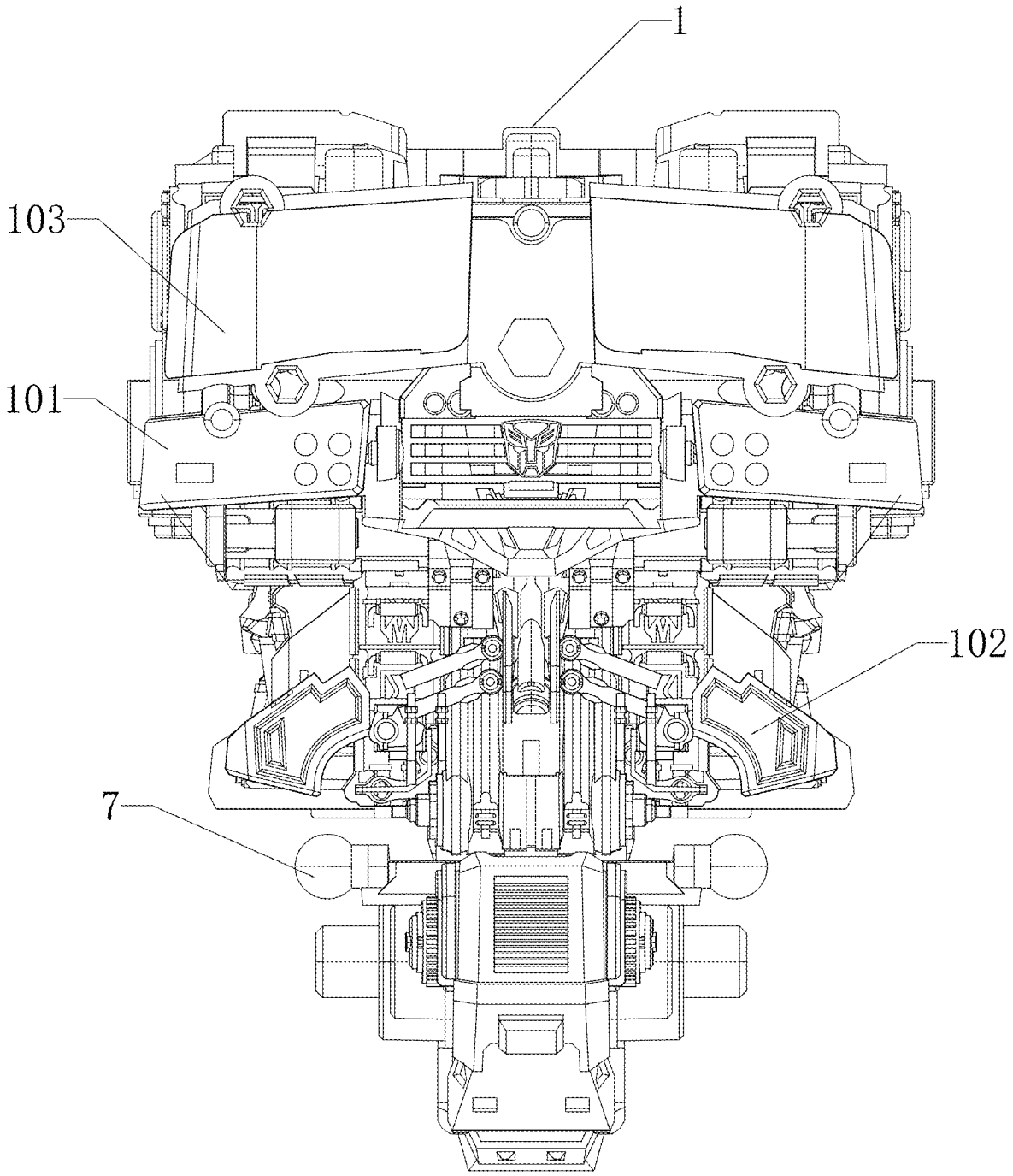
FIG. 6 is a front view of the overall structure of the trunk model according to the present invention.
Figure 7:
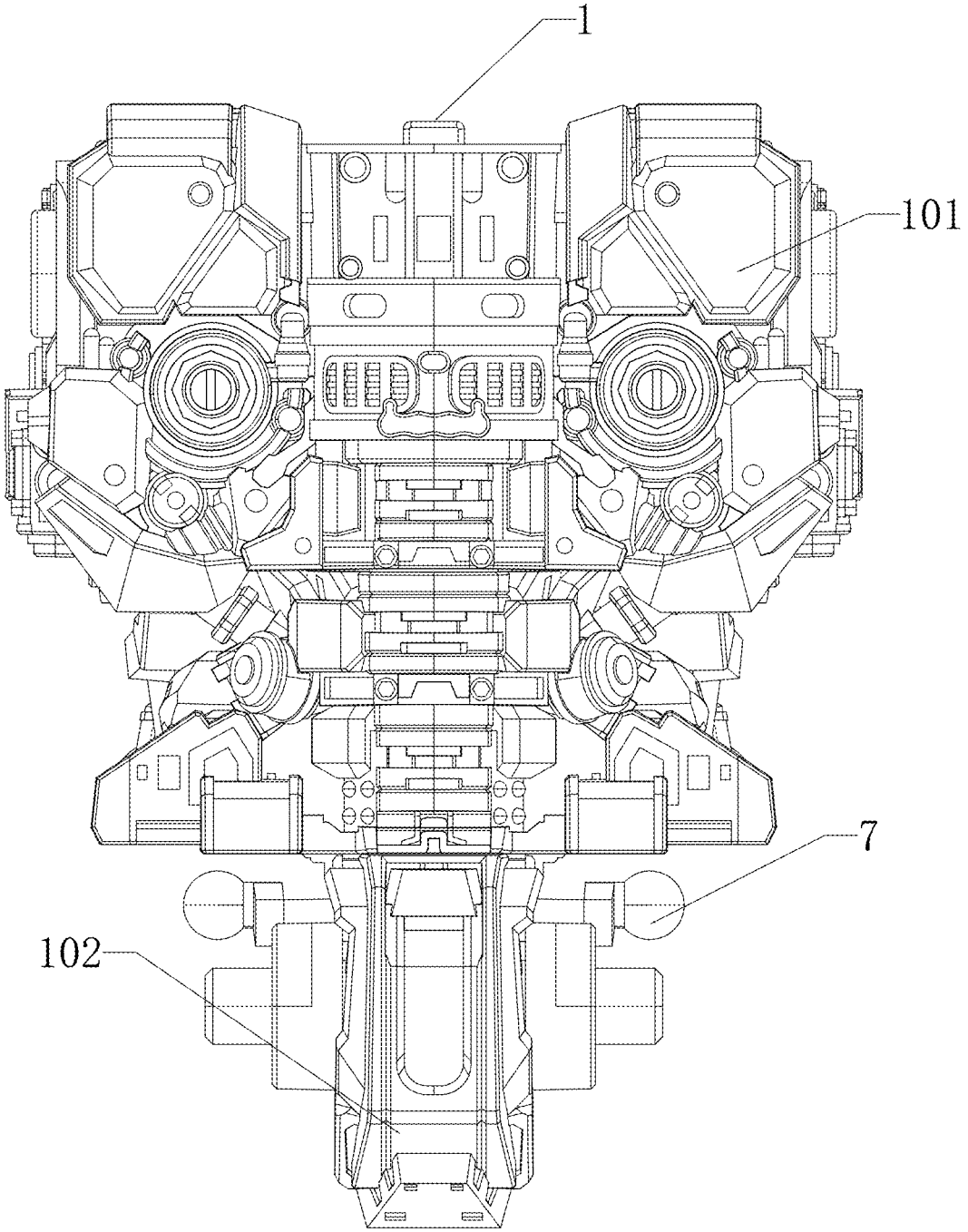
FIG. 7 is a rear view of the overall structure of the trunk model according to the present invention.
Figure 8:
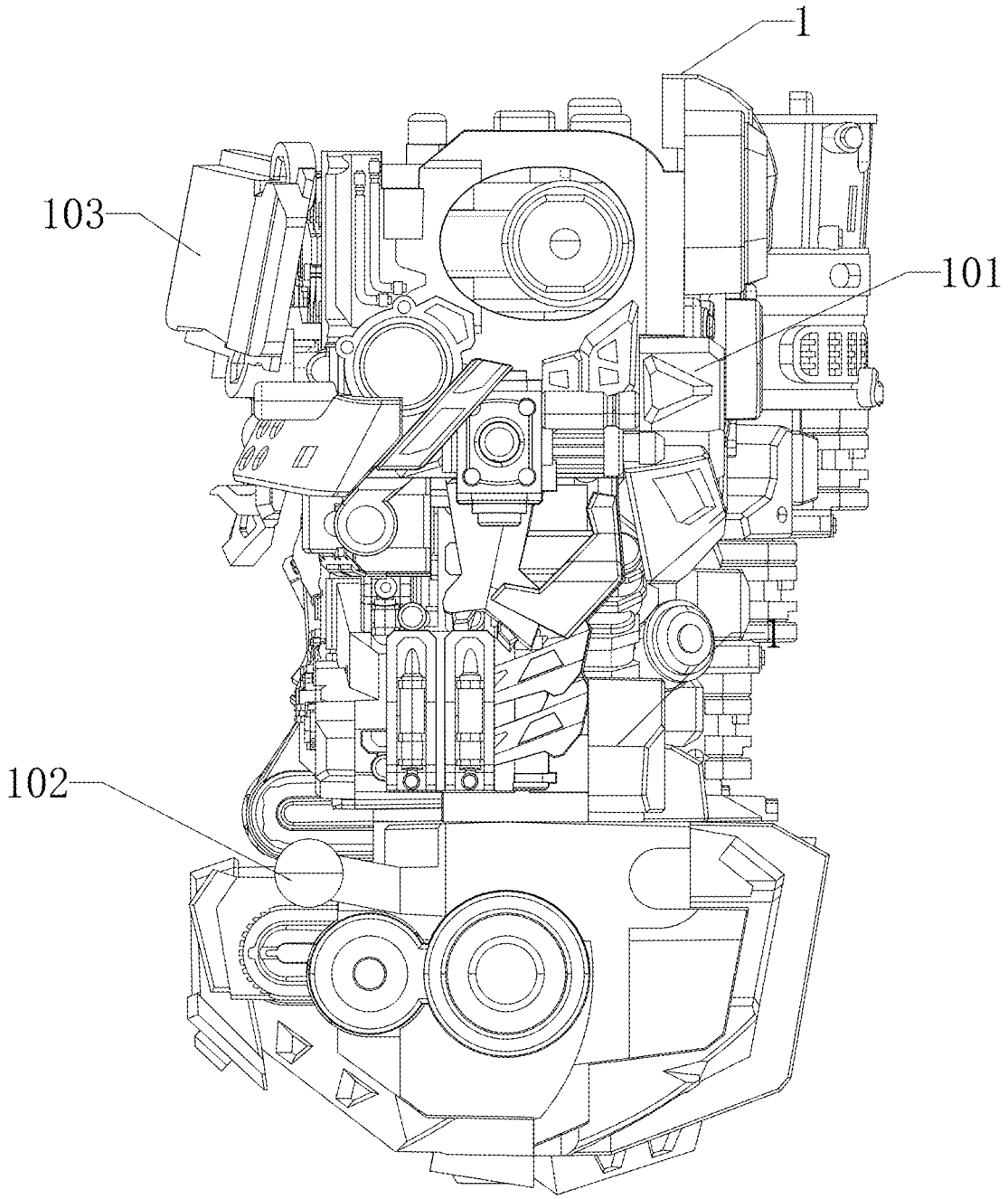
FIG. 8 is a right side view of the overall structure of the trunk model according to the present invention.

In the figure: 1. Trunk model; 101 model chest 102 model waist and abdomen 103 front chest baffle

2. Head model; 201 model head 202 connecting column 203 connection block 204 model neck 205 ball-bowl structure 206 model ear

3. Left arm model; 301 left big arm model 302 left forearm model 303 first connection pad 304 first connection plug 305 left chimney model

4. Right arm model; 401 right big arm model 402 right forearm model 403 second connection pad 404 second connection plug 405 right chimney model

5. Left leg model; 501 left thigh model 502 left calf model 503 left foot model 504 left foot collar 505 first ball-bowl sleeve

6. Right leg model; 601 right thigh model 602 right calf model 603 right foot model 604 right foot collar 605 second ball-bowl sleeve

7. Ball-head connection mechanism; 701 connecting hemisphere 702 connecting pile 703 splice post 704 elastic plate 705 assembly hemisphere 706 assembly column

8. Model hand.

DETAILED DESCRIPTION

Hereinafter, the technical solutions in the embodiments of the present invention will be clearly and completely described with reference to the accompanying drawings in the embodiments of the present invention. Obviously, the embodiments described are only a part of the embodiments of the present invention, but not all of the embodiments. Based on the embodiments in the present invention, all other embodiments obtained by those skilled in the art without creative work fall within the scope of protection of the present invention.

The present invention provides a quickly pre-assembled model product as shown in FIGS. 1 to 4, which is formed by mutually sleeving and assembling a trunk model 1, a head model 2, an arm model, a leg model and a model hand 8;

In the present invention, the model of the entire character shape is divided into a trunk model 1, a head model 2, an arm model, a leg model, and a model hand 8. Through the definition of each model part, the whole model product can be assembled and spliced around the trunk model 1. In this way, according to the definition and shape of each part, the splicing of each part can be carried out correspondingly. Such structural setting makes the splicing of this model product more convenient and quick.

Specifically, referring to FIGS. 5 to 8, there is a schematic diagram of a part of the trunk model 1, the trunk model 1 includes a model chest 101 and a model waist and abdomen 102, and the top of the model chest 101 is provided with a ball-bowl-shaped groove for connecting the head model 2; The bottom of the model chest 101 is connected with the top of the model waist and abdomen 102 in a rotational interspersed manner, both sides of the bottom of the model waist and abdomen 102 are provided with ball-head connecting mechanisms 7 for connecting the left leg model 5 and the right leg model 6 respectively, and the front of the model chest 101 is provided with a front chest baffle 103.

It should be noted that in the setting of this product, the trunk model 1 is a pre-assembled model structure; That is, the model chest 101 and the model waist and abdomen 102 are pre-assembled in advance, and the model chest 101 and the model waist and abdomen 102 are rotationally interspersed and connected. In this way, the chest 101 of the model and the waist and abdomen 102 of the model can be rotated by 180° from the left to the right, so that the trunk part of the whole model can also be flexibly rotated and adjusted.

Figure 9:
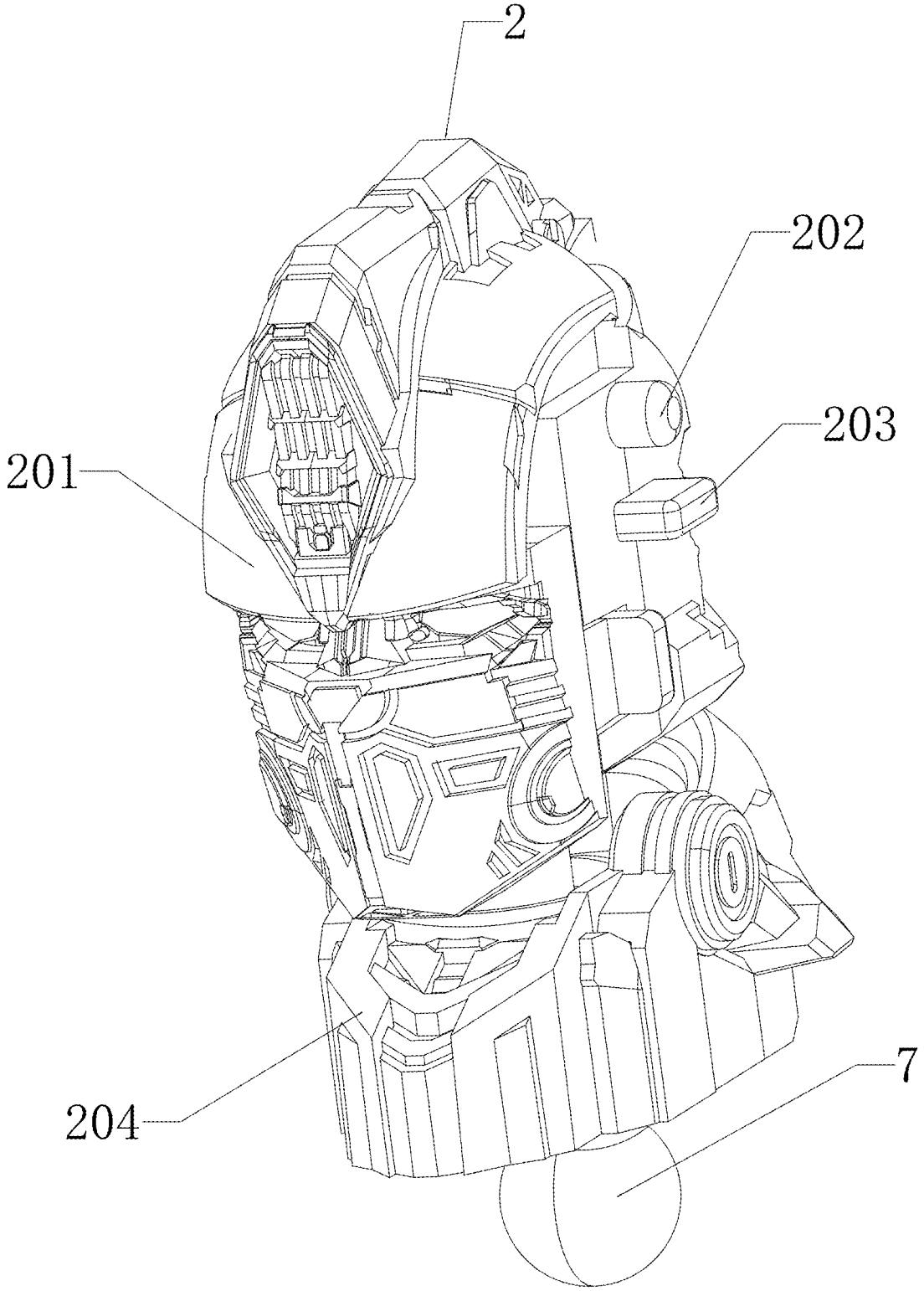
FIG. 9 is a schematic diagram of the overall structure of the head model according to the present invention.
Figure 10:
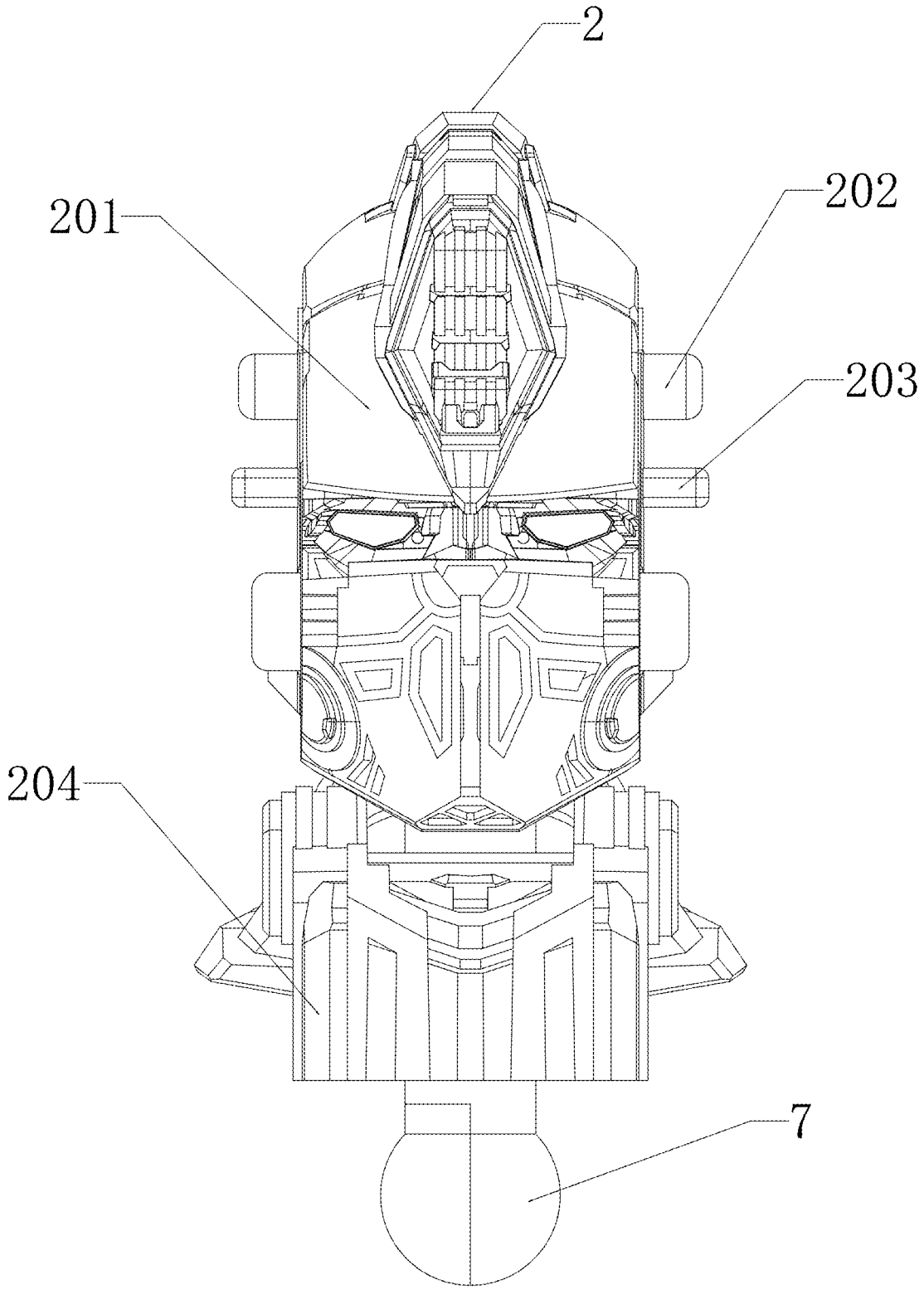
FIG. 10 is a front view of the overall structure of the head model according to the present invention.
Figure 11:
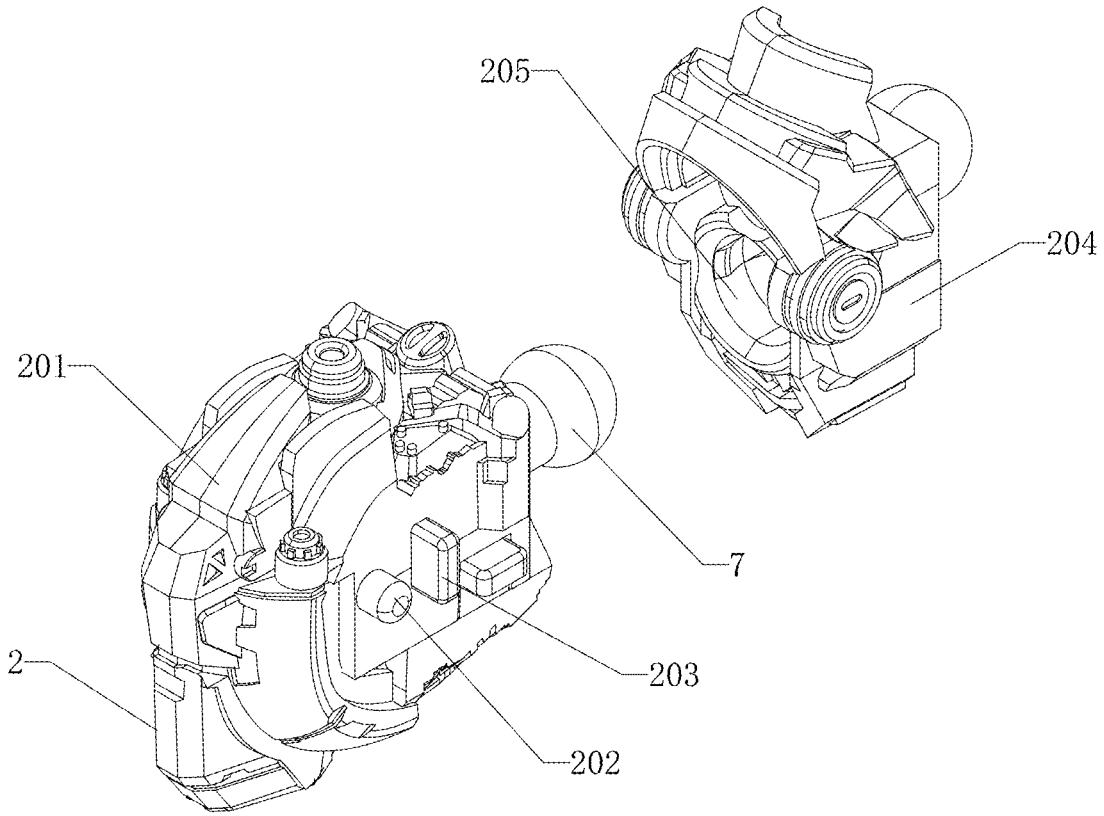
FIG. 11 is an explosion view of the overall structure of the head model according to the present invention.

The head model 2 is arranged on the top of the trunk model 1, a ball-head connecting mechanism 7 is arranged between the connection of the head model 2 and the trunk model 1, and the head model 2 and the trunk model 1 realize rotation adjustment through the ball-head connecting mechanism 7;

Specifically, referring to FIGS. 9 to 11, there is a schematic diagram of a part of a head model 2, and the head model 2 includes:

A model head 201, both sides of the model head 201 are provided with connecting pieces, one end of the connecting pieces far away from the model head 201 is sleeved with a model ear 206, and the bottom of the model head 201 is fixedly connected with one group of ball-head connecting mechanisms 7;

Further, the connecting member includes a connecting column 202 and a connecting insert block 203, the plurality of connecting column 202 and the connecting insert block 203 are symmetrically disposed on both sides of the model head 201 along the horizontal and horizontal directions, and the connecting insert block 203 is disposed below the connecting column 202;

It should be noted that the connecting column 202 and the connecting insert block 203 are spliced with the model ear 206, and the model ear 206 belongs to the decorative model component, which needs to be adjusted and operated in synchronization with the model head 201. Therefore, the structure of the connecting column 202 and the connecting block 203 is adopted, so that the model ear 206 can stably maintain the connection with the model head 201 when the model ear 206 is connected, and then the adjustment of the model head 201 drives the model ear 206 to be synchronized.

The model neck 204, the top of which is provided with a ball-bowl structure 205, and the model neck 204 is sleeved with the ball-head connecting mechanism 7 at the bottom of the model head 201 through the ball-bowl structure 205. The bottom of the model neck 204 is fixedly connected with the ball-head connecting mechanism 7 for connecting the trunk model 1, and the ball-head connecting mechanism 7 at the bottom of the model neck 204 is rotationally interspersed and connected with the ball-bowl groove at the top of the model chest 101.

It should be noted that the model neck 204 adopts a ball-bowl structure 205 to rotate and sleeve with the ball-head connecting mechanism 7 at the bottom of the model head 201. The connection form of the ball head enables the model head 201 to be adjusted on the top of the model neck 204, and the adjustment range of the model head 201 can be limited according to the setting of the structural shape of the top of the model neck 204.

Figure 12:
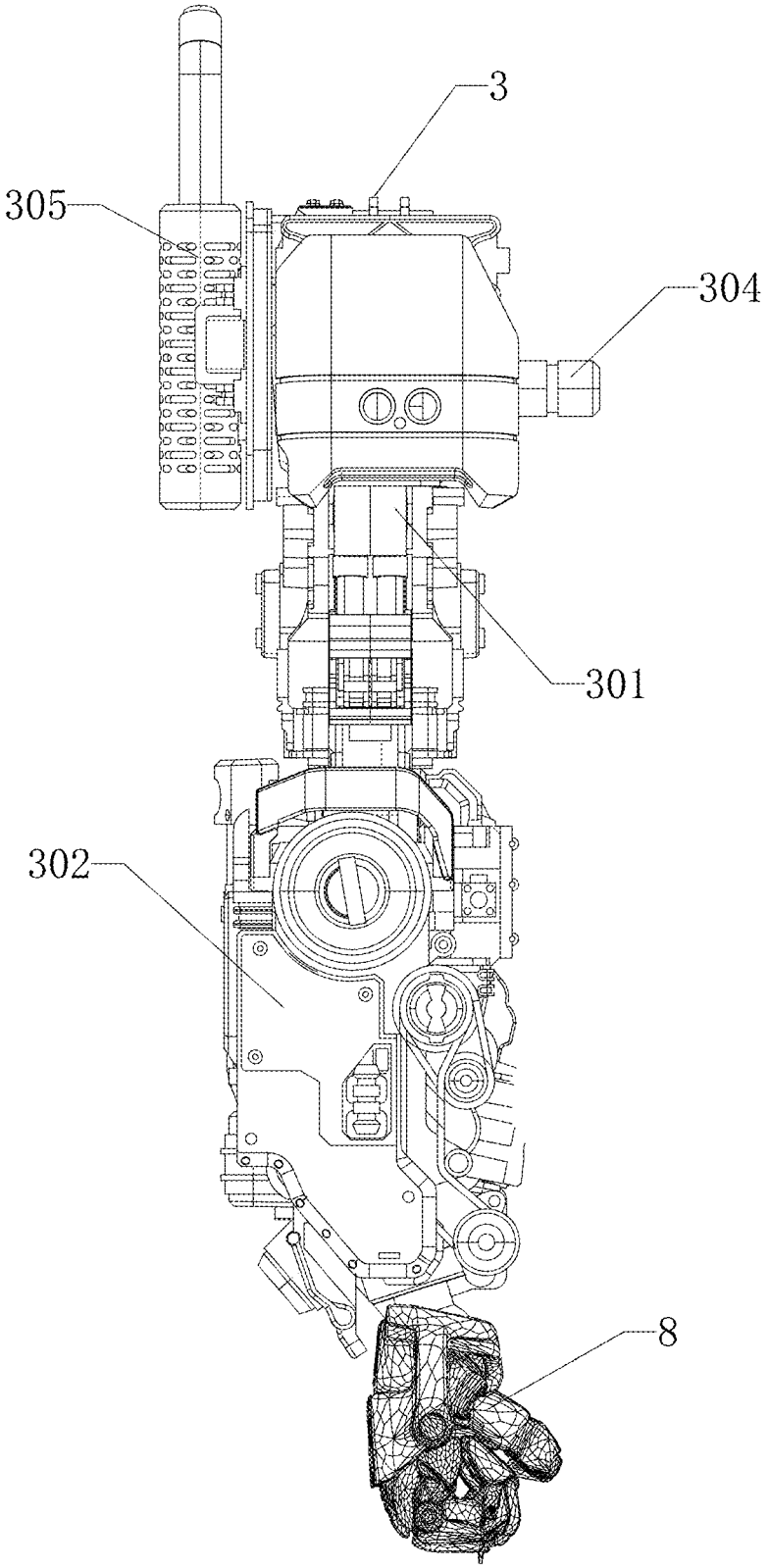
FIG. 12 is a schematic diagram showing a structural connection between a left arm model and a model hand according to the present invention.
Figure 13:
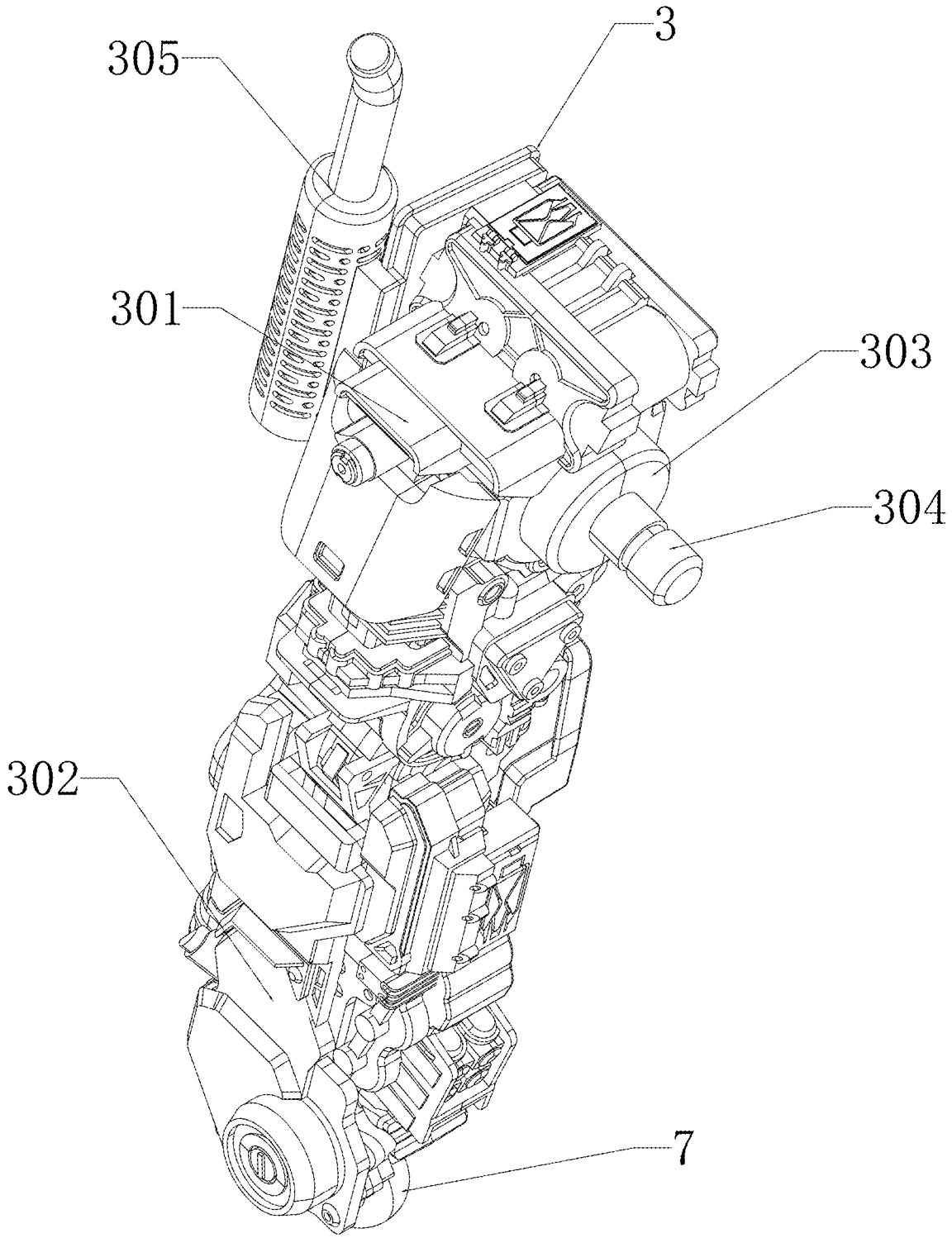
FIG. 13 is a schematic diagram of the overall structure of the left arm model according to the present invention.
Figure 14:
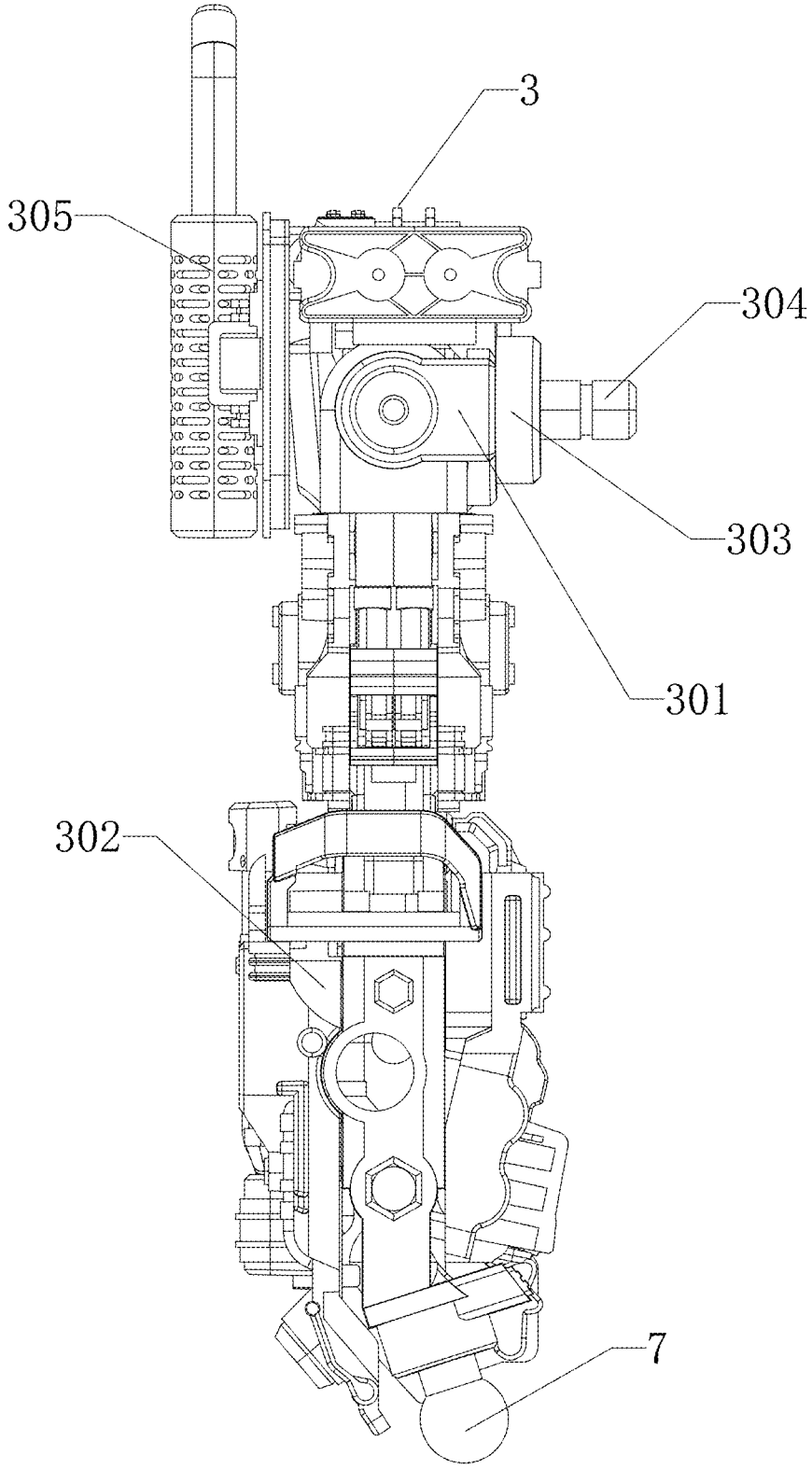
FIG. 14 is a front view of the overall structure of the left arm model according to the present invention.

The arm model includes a left arm model 3 and a right arm model 4, and the left arm model 3 is arranged on the left side of the top of the trunk model 1; The right arm model 4 is arranged on the right side of the top of the trunk model 1, and a first round rod connecting mechanism and a second round rod connecting mechanism are respectively arranged at the connections between the left arm model 3 and the right arm model 4 and the trunk model 1. The left arm model 3 and the right arm model 4 realize 360° rotation in the vertical direction on both sides of the top of the trunk model 1 through the first round rod connecting mechanism and the second round rod connecting mechanism respectively;

Specifically, with reference to FIGS. 12 to 14, the left arm model 3 includes:

A left boom model 301, the right side of which is used for connecting the first round rod connecting mechanism, and the right side of the left boom model 301 is provided with a left chimney model 305;

Left forearm model 302, the top of the left forearm model 302 is hinged with the bottom of the left forearm model 301, and the rotation angle of the left forearm model 302 and the left forearm model 301 is 0° to 150°. The bottom of the left forearm model 302 is used for connecting the model hand 8 by providing a ball-head connection mechanism 7.

It should be noted that, after the left forearm model 302 and the left forearm model 301 are hinged, the top structural shape of the left forearm model 302 is matched with the bottom structural shape of the left forearm model 301, so that the rotation angle of the two is limited to 0° to 150°; The ball-head connecting mechanism 7 is provided at the bottom of the left forearm model 302 to connect the model hands 8, so that the rotation adjustment of the model hands 8 after connection is more flexible, and the operation and play of the model are more flexible. In the actual assembly process of the model, the hand shape of the model hand 8 can be personalized and customized, so as to match the limbs of the whole model to decorate the corresponding shape.

Further, the first round rod connecting mechanism includes a first connecting disk 303, and the first connecting disk 303 is provided on the right side of the left boom model 301. The side of the first connecting disk 303 away from the left big arm model 301 is provided with a first connecting insert column 304, and the first connecting insert column 304 is rotationally interspersed and connected with the left side of the model chest 101.

Note that, in the present model, the first connection post 304 is rotationally inserted and connected to the left side of the model chest 101. Under the restriction of the structural shape of the first connection insert 304, the left arm model 3 can only rotate 360° in the vertical direction around the left side of the model chest 101, which is different from the ball-head connection structure.

Figure 15:
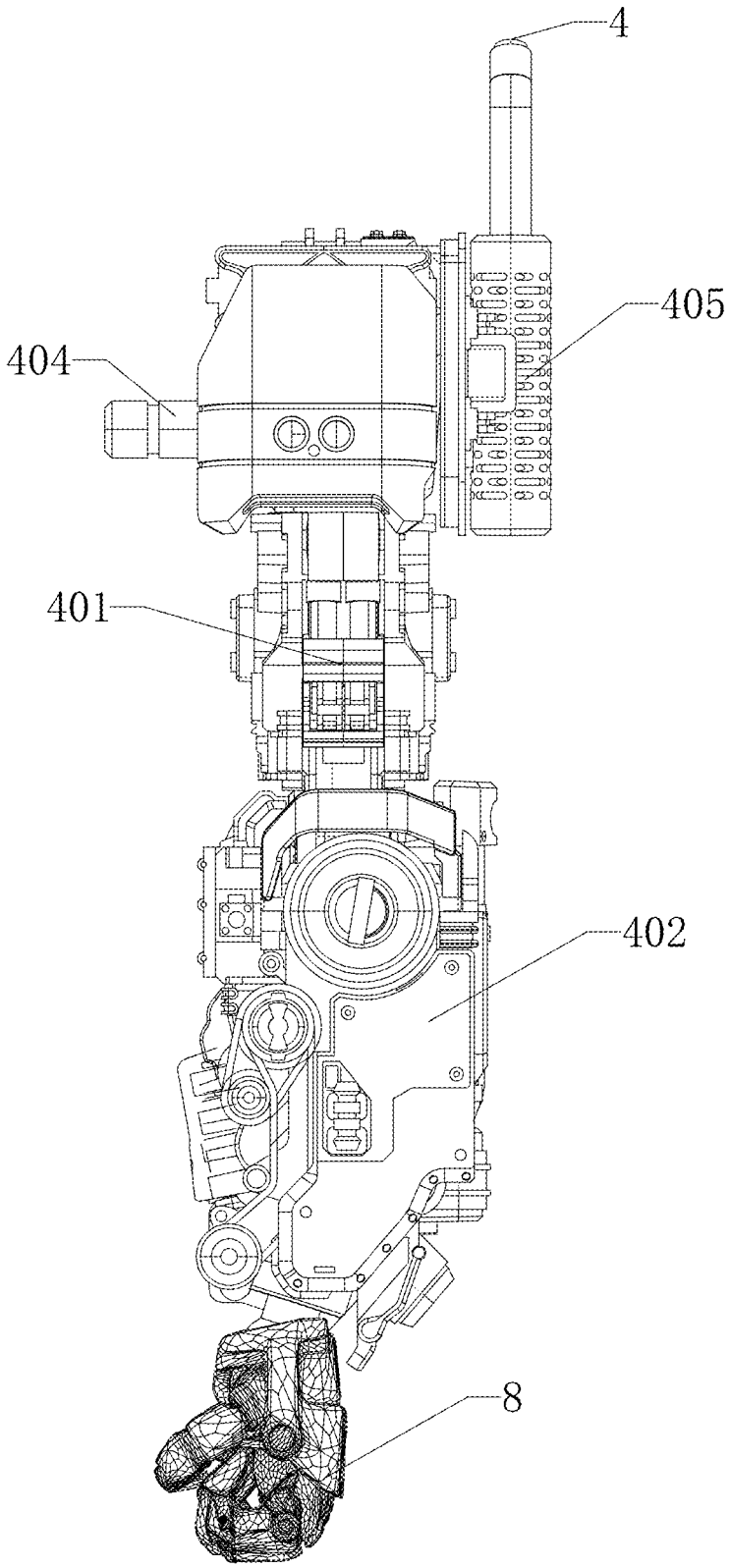
FIG. 15 is a schematic diagram showing a structural connection between a right arm model and a model hand according to the present invention.
Figure 16:
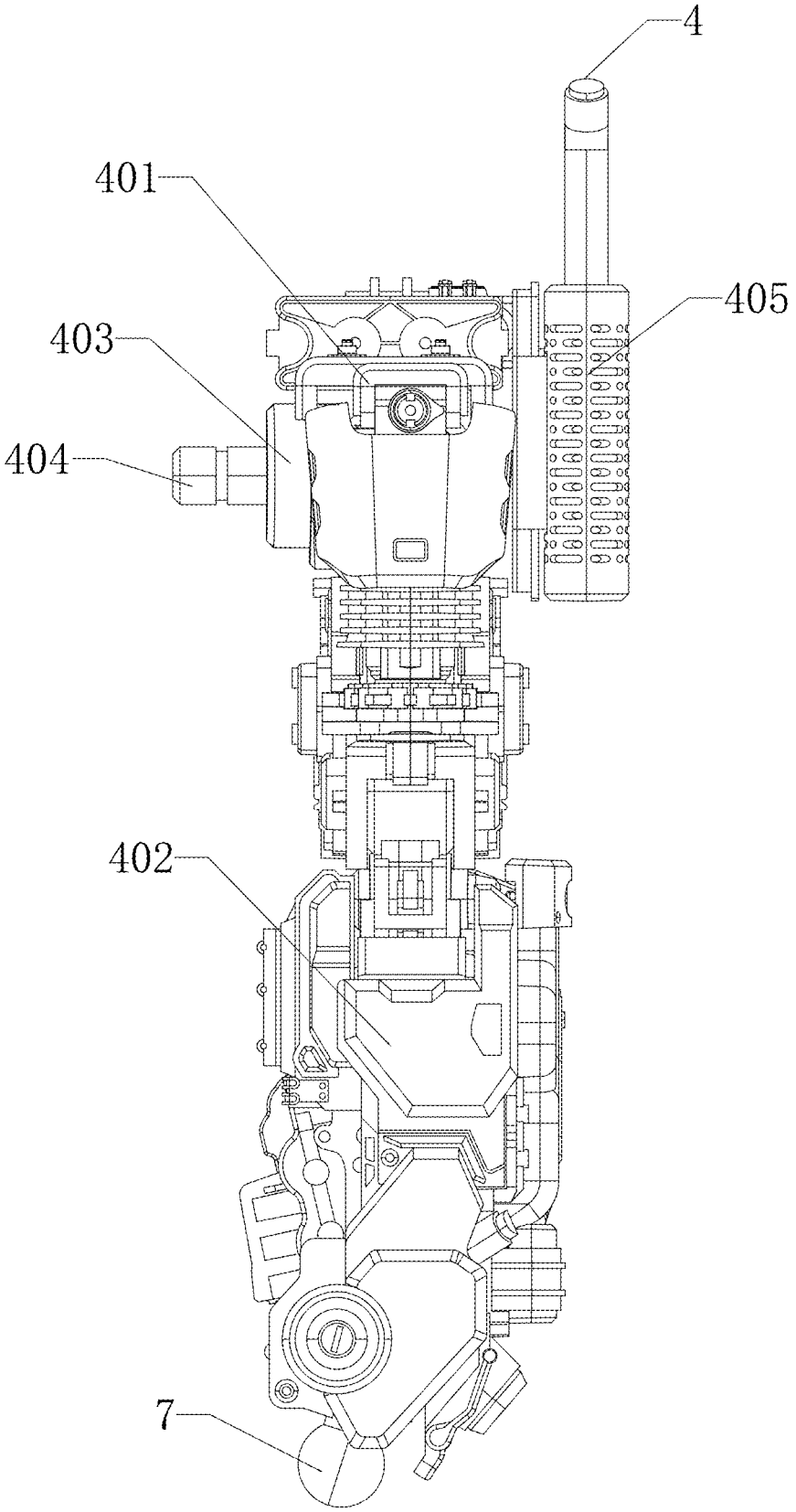
FIG. 16 is a front view of the entire structure of the right arm model according to the present invention.

Specifically, with reference to FIGS. 15 and 16, the right arm model 4 includes:

A right boom model 401, the left side of which is used for connecting the second round rod connecting mechanism, and the right side of the right boom model 401 is provided with a right chimney model 405;

Right forearm model 402, the top of the right forearm model 402 is hinged with the bottom of the right forearm model 401, and the rotation angle of the right forearm model 402 and the right forearm model 401 is 0° to 150°. The bottom portion of the right forearm model 402 is used for connecting the model hand 8 by providing a ball-head connection mechanism 7.

It should be noted that, after the right forearm model 402 and the right forearm model 401 are articulated, the top structural shape of the right forearm model 402 is matched with the bottom structural shape of the right forearm model 401, so that the rotation angle of the two is limited to 0° to 150°; The ball-head connecting mechanism 7 is provided at the bottom of the right forearm model 402 to connect the model hands 8, so that the rotation adjustment of the model hands 8 is more flexible after the connection, and then the operation and play of the model are more flexible, and the principle is the same as the connection at the left arm model 3.

Further, the second round rod connection mechanism includes a second connection plate 403 provided on the left side of the right boom model 401, and the second connection plate 403 is disposed on the left side of the right boom model 401, and the second connection plate 403 is disposed on the left side of the right boom model 401. A side of the second connecting disk 403 away from the right big arm model 401 is provided with a second connecting insert column 404, and the second connecting insert column 404 is rotationally interspersed and connected with the right side of the model chest 101.

Note that, in the present model, the second connection insert column 404 is rotationally inserted and connected to the right side of the model chest 101. Under the restriction of the structural shape of the second connecting column 404, the right arm model 4 can only rotate 360° in the vertical direction around the right side of the model chest 101, which is different from the ball-head connecting structure, and the right arm model 4 can only be rotated by 360° in the vertical direction around the right side of the model chest 101.

The leg model includes a left leg model 5 disposed on the left side of the bottom of the trunk model 1 and a right leg model 6 disposed on the right side of the bottom of the trunk model 1. The left leg model 5, the right leg model 6 and the trunk model 1 are rotated by 360° in the vertical direction at both sides of the bottom of the trunk model 1 through a ball-head connecting mechanism 7. The left leg model 5 and the right leg model 6 and the trunk model 1 are rotated in the vertical direction at both sides of the bottom of the trunk model 1.

Specifically, with reference to FIGS. 15 and 16, the left leg model 5 includes:

A left thigh model 501, the right side of the top of the left thigh model 501 is provided with a first ball-bowl sleeve 505 for connecting with the ball-head connecting mechanism 7 at the left side of the bottom of the waist and abdomen 102 of the model;

A left calf model 502, the top portion of the left calf model 502 is hinged with the bottom portion of the left thigh model 501, and the rotation angle of the left calf model 502 and the left thigh model 501 along the horizontal longitudinal direction ranges from −90° to 90°;

It is to be noted that the first ball-bowl sleeve 505 is connected to the ball joint connection mechanism 7 at the waist and abdomen 102 of the model. In this way, the structure at the waist and abdomen 102 of the model is matched with the structural shape of the left leg model 5, so that the rotation angle adjustment range of the left leg model 5 is set at −90° to 90°, that is, the rotation angle adjustment range of the left leg model 5 is rotated by ninety degrees forward and backward.

A left foot model 503, the left foot model 503 is set at the bottom of the left calf model 502, and the horizontal and horizontal rotation angle between the left foot model 503 and the left calf model 502 ranges from −70° to 70°. A left foot collar 504 is hinged at the top of the left foot model 503, and the rotation angle of the left foot collar 504 in the vertical direction is 0° to 30°.

It should be noted that after the hinge is adopted between the left foot model 503 and the left calf model 502, the left foot model 503 can rotate laterally by −70° to 70°, that is, rotate left and right by seventy degrees; The left foot collar 504 is also in a hinged connection, allowing it to flip up thirty degrees.

Figure 17:
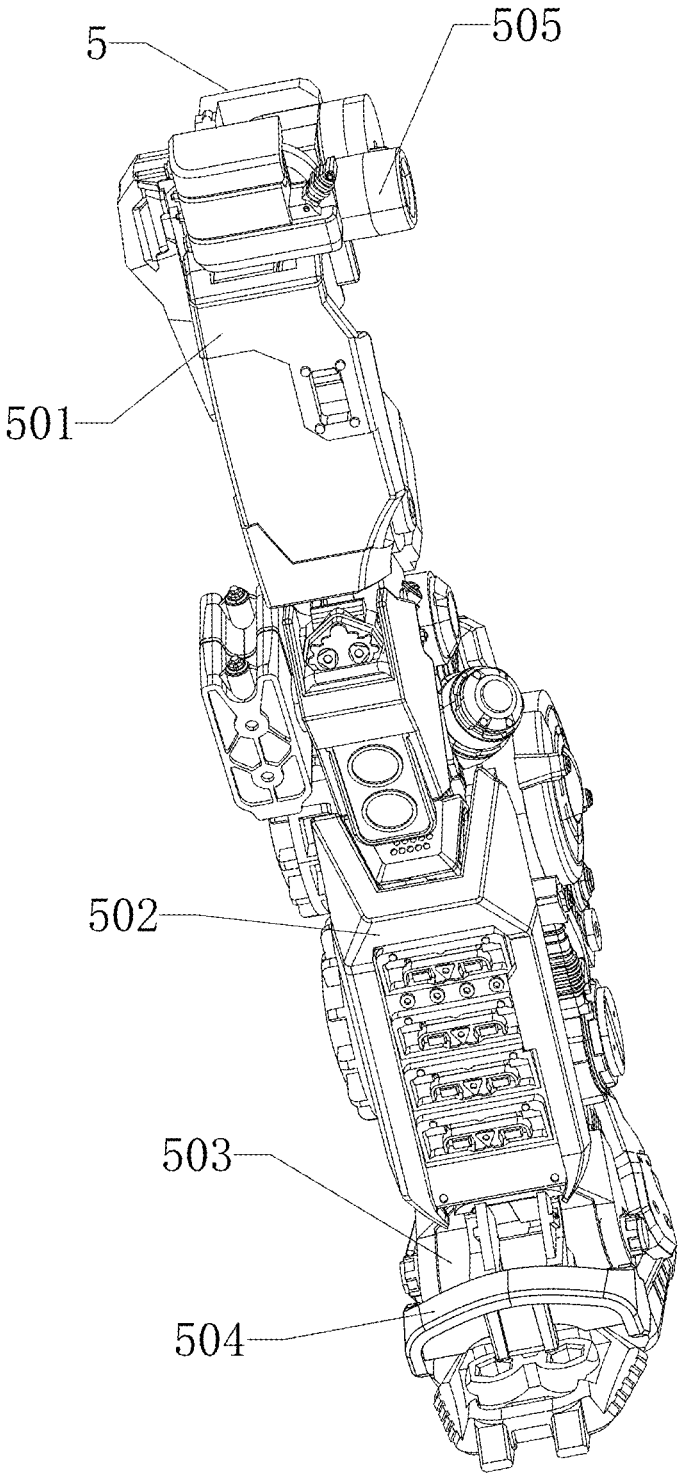
FIG. 17 is a schematic diagram of the overall structure of the left leg model according to the present invention.
Figure 18:
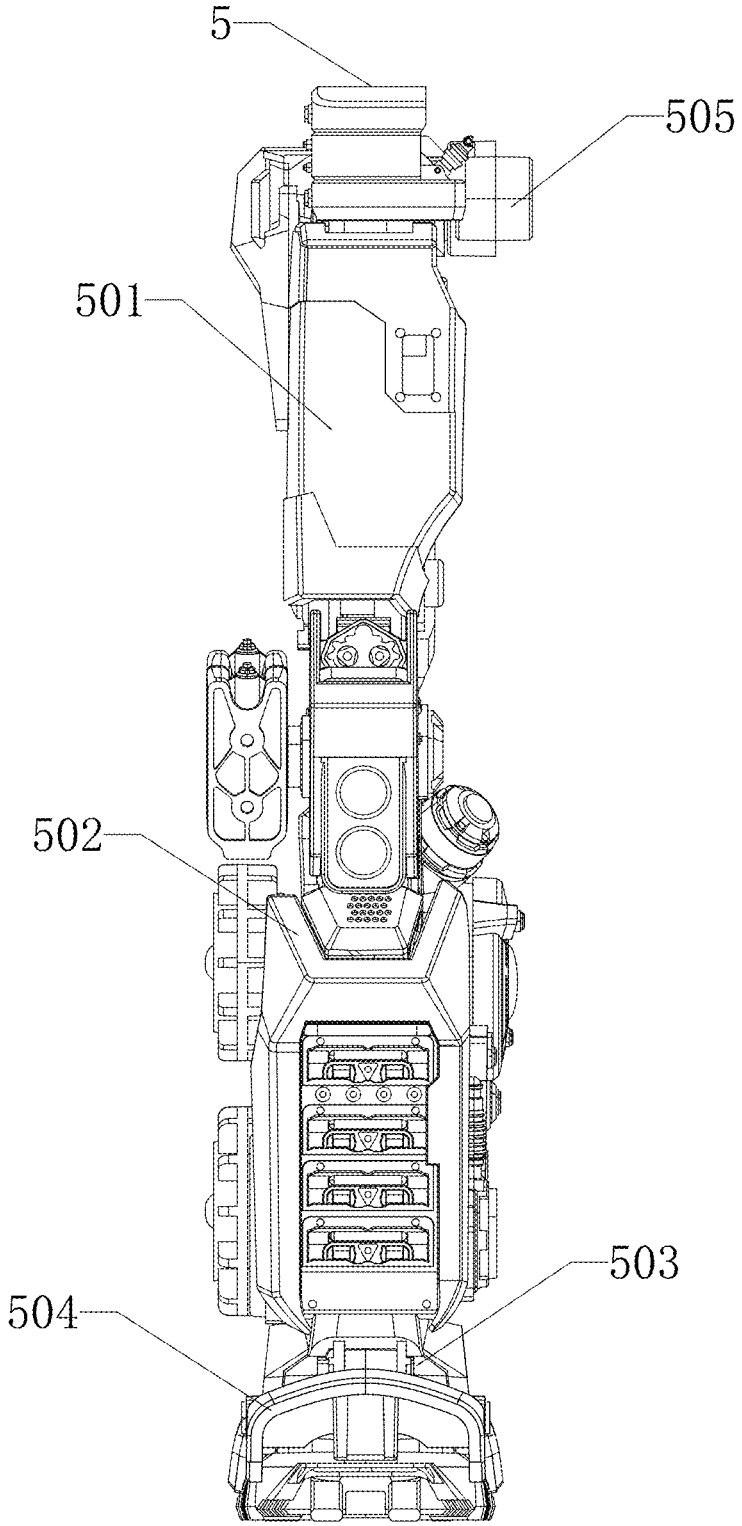
FIG. 18 is a front view of the overall structure of the left leg model according to the present invention.

Specifically, with reference to FIGS. 17 and 18, the right leg model 6 includes:

A right thigh model 601, the left side of the top of the right thigh model 601 is provided with a second ball-bowl sleeve 605 for connecting with the ball-head connecting mechanism 7 at the right side of the bottom of the waist and abdomen 102 of the model;

A right calf model 602, the top portion of the right calf model 602 is hinged with the bottom portion of the right thigh model 601, and the rotation angle of the right calf model 602 and the right thigh model 601 along the horizontal longitudinal direction ranges from −90° to 90°;

It should be noted that the second ball-bowl sleeve 605 is connected by matching the ball-head connecting mechanism 7 at the waist and abdomen 102 of the model, so that the structure at the waist and abdomen 102 of the model is matched with the structural shape of the right leg model 6, so that the rotation angle adjustment range of the right leg model 6 is set at −90° to 90°, that is, the rotation angle adjustment range of the right leg model 6 is rotated by ninety degrees forward and backward.

A right foot model 603, the right foot model 603 is set at the bottom of the right calf model 602, and the horizontal and horizontal rotation angle between the right foot model 603 and the right calf model 602 ranges from −70° to 70°. A right foot collar 604 is hinged to the top of the right foot model 603, and the rotation angle of the right foot collar 604 in the vertical direction is 0° to 30°.

It should be noted that after the hinge is adopted between the right foot model 603 and the right calf model 602, the right foot model 603 can rotate laterally by −70° to 70°, that is, rotate right to right by seventy degrees. While the right foot collar 604 is also in a hinged connection, allowing it to be turned upward thirty degrees.

Figure 19:
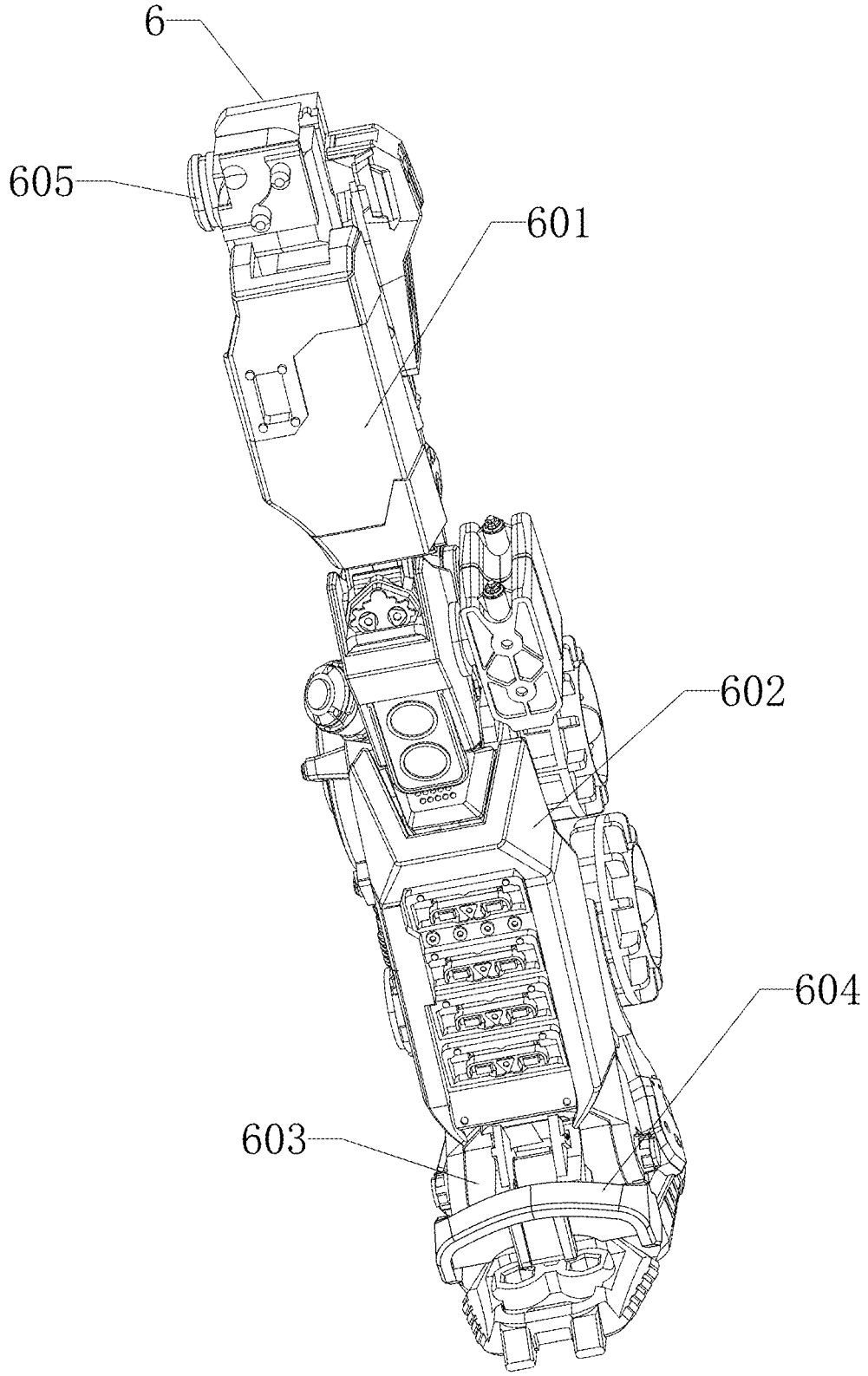
FIG. 19 is a schematic diagram of the overall structure of the right leg model according to the present invention.
Figure 20:
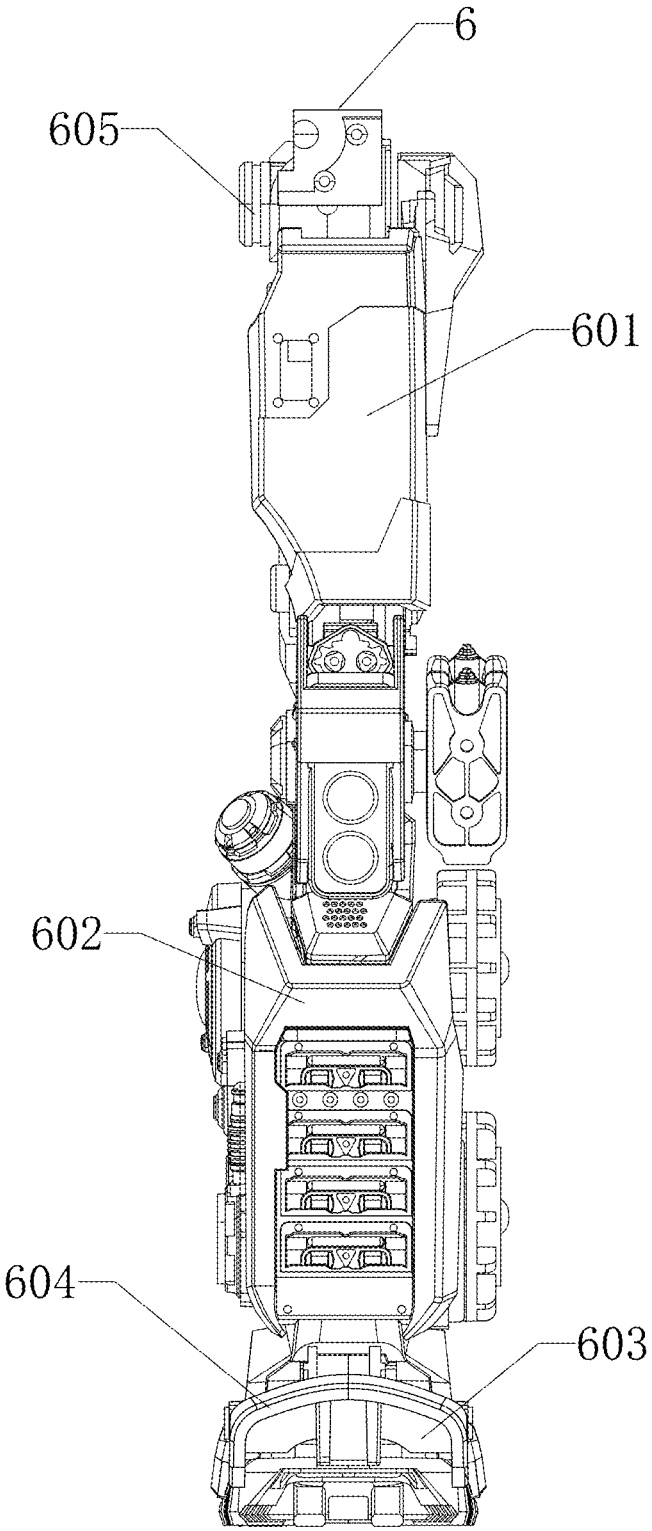
FIG. 20 is a front view of the entire structure of the right leg model according to the present invention.
Figure 21:
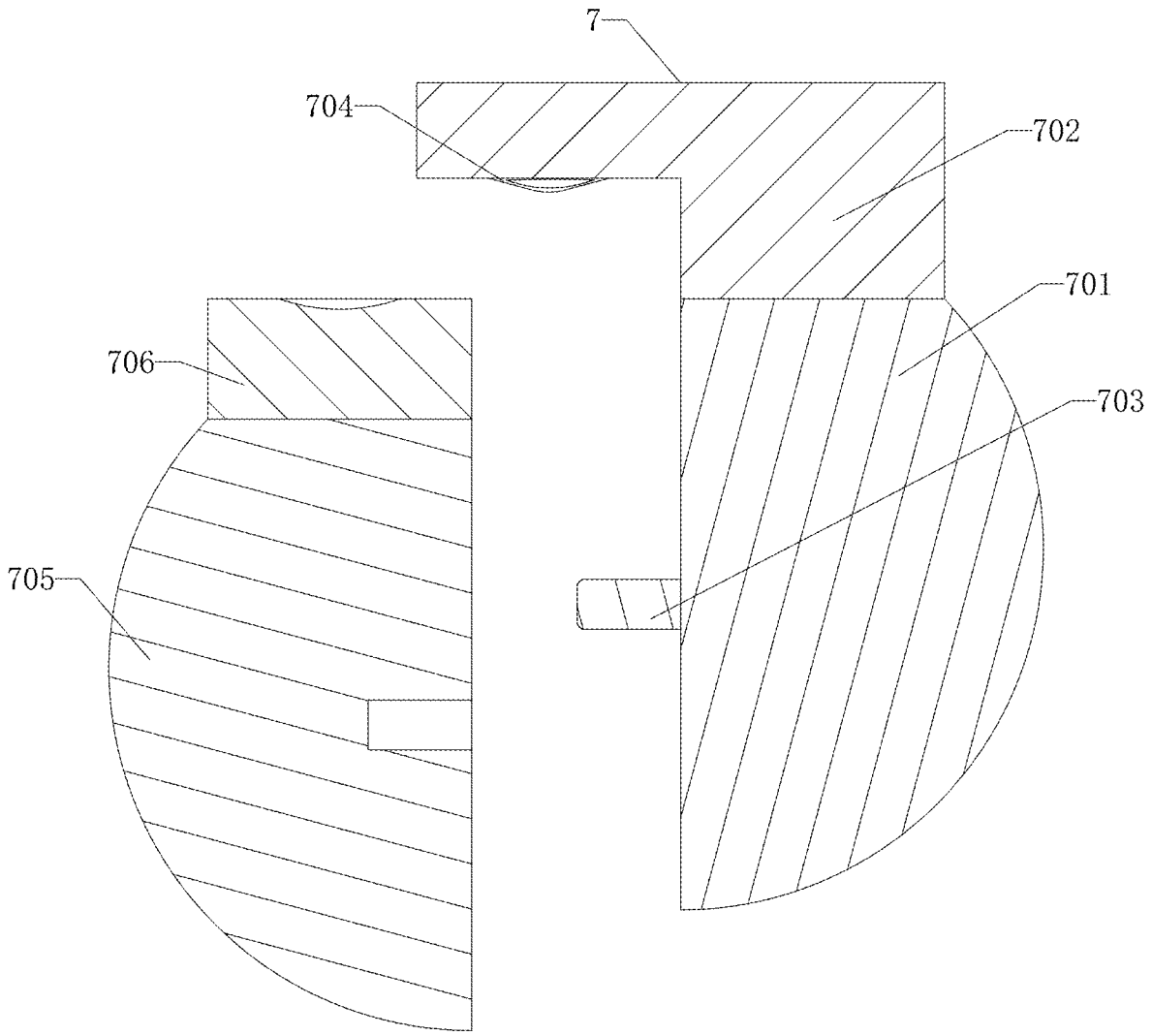
FIG. 21 is a cross-sectional explosion view of the ball-head connection mechanism according to the present invention.

Specifically, referring to FIG. 19, the ball-head connection mechanism 7 includes:

Connecting hemisphere 701, the top of the connecting hemisphere 701 is provided with a connecting pile 702, the connecting pile 702 is used for fixing the ball-head connecting mechanism 7 and other components, and one side of the middle part of the connecting hemisphere 701 is provided with a splicing post 703. One side of the bottom of the connecting pile 702 is provided with a connecting port, and the inner wall of the top end of the connecting port is provided with an elastic plate 704;

An assembly hemisphere 705, a splicing groove is provided on one side of the assembly hemisphere 705, a splicing post 703 is interspersed and connected with the splicing groove, and an assembly post 706 is provided on the top of the assembly hemisphere 705; The assembly column 706 is arranged in the connection port, the top end of the assembly column 706 is provided with a placement groove, and the elastic plate 704 is interspersed and connected in the placement groove.

Note that the connecting pile 702 has a cylindrical structure, and the diameter thereof is the same as the diameter of the connecting hemisphere 701 and the assembling hemisphere 705. Therefore, the connecting hemisphere 701 and the assembling hemisphere 705 are spliced together to form a complete spherical structure. The accuracy of the docking between the two is realized by the interspersion between the splicing post 703 and the splicing groove. In order to enhance the frictional force after being interspersed between the splicing post 703 and the splicing groove, the elastic plate 704 and the placement groove are formed by pressing each other. The middle part of the elastic plate 704 is a hollow structure, and the elastic plate 704 is made of elastic plastic. Therefore, it deforms and shrinks after being squeezed, and then its restoring force reacts to the inner wall of the placement groove, causing the assembly hemisphere 705 to be squeezed, thereby causing the inner wall of the splicing groove to be squeezed against the outer wall of the splicing post 703, increasing the friction force during contact. Also, the connecting hemisphere 701 and the assembling hemisphere 705 are spliced into a complete ball shape, which is also convenient for the subsequent connection and use of the connecting hemisphere 701 and the assembling hemisphere 705.

Finally, it should be noted that the foregoing is merely a preferred embodiment of the present invention, and is not intended to limit the present invention. Although the present invention has been described in detail with reference to the above-described embodiments, those skilled in the art can still modify the technical solutions described in the above-described embodiments, or make equivalent replacements for some technical features thereof. Any modification, equivalent substitution, improvement, etc. made within the spirit and principles of the present invention should be included within the scope of protection of the present invention.

What is claimed is:

1. A quick pre-assembled model is characterized in that it is assembled by mutually sleeving a trunk model, a head model, an arm model, a leg model and a model hand;

The head model is arranged on the top of the trunk model, a ball-head connecting mechanism is arranged between the connection of the head model and the trunk model, and the head model and the trunk model realize rotational adjustment through the ball-head connecting mechanism;

The arm model includes a left arm model and a right arm model, the left arm model is arranged on the left side of the top of the trunk model, and the right arm model is arranged on the right side of the top of the trunk model; The connection between the left arm model and the right arm model and the trunk model is respectively provided with a first round rod connecting mechanism and a second round rod connecting mechanism; The left arm model and the right arm model realize 360° rotation in the vertical direction on both sides of the top of the trunk model through the first round rod connecting mechanism and the second round rod connecting mechanism respectively; the left arm model and the right arm model realize the first round rod connecting mechanism and the right arm model rotate in the vertical direction of the two sides of the top of the trunk model;

The leg model comprises a left leg model and a right leg model, the left leg model is arranged on the left side of the bottom of the trunk model, and the right leg model is arranged on the right side of the bottom of the trunk model; The left leg model and the right leg model and the trunk model are rotated 360° in the vertical direction at both sides of the bottom of the trunk model by ball-head connecting mechanism, and the left leg model and the right leg model and the trunk model are rotated in the vertical direction at both sides of the bottom of the trunk model;

A wrist end of the model hand is provided with a groove, and the groove and the arm model realize rotational adjustment through a ball-head connecting mechanism;

The trunk model comprises a model chest and a model waist and abdomen, the top of the model chest is provided with a ball-bowl groove for connecting the head model; The bottom of the chest of the model is connected with the top of the waist and abdomen of the model by rotating and interspersed, and both sides of the bottom of the waist and abdomen of the model are provided with ball-head connecting mechanisms respectively used for connecting the left leg model and the right leg model; The front side of the model chest is provided with a front chest baffle.

2. A quick pre-assembled model product according to claim 1, characterized in that the head model comprises:

A model head, both sides of the model head are provided with connecting pieces, and one end of the connecting piece far away from the model head is sleeved with a model ear; The bottom of the model head is fixedly connected with one group of ball-head connecting mechanism;

The connecting piece includes a connecting column and a connecting insert, and a plurality of the connecting column and the connecting insert are symmetrically arranged on both sides of the model head along horizontal and transverse directions; The connecting insert block is arranged below the connecting column;

A model neck, the top of which is provided with a ball-bowl structure, the model neck is sleeved with a ball-head connecting mechanism at the bottom of the model head by ball-bowl structure; The bottom of the model neck is fixedly connected with a ball-head connecting mechanism for connecting the trunk model, and the ball-head connecting mechanism at the bottom of the model neck is rotatably interspersed and connected with a ball-bowl groove at the top of the model chest.

3. A quick pre-assembled model product according to claim 1, characterized in that the left arm model comprises:

A left big arm model, a right side of which is used for connecting the first round rod connecting mechanism, and a left chimney model is provided on the right side of the left big arm model;

A left forearm model, a top portion of the left forearm model hinged with a bottom portion of the left big arm model; The rotation angle of the left forearm model and the left big arm model is 0° to 150°.

4. A quick pre-assembled model product according to claim 3, wherein the first round rod connecting mechanism includes a first connecting disk, and the first connecting disk is arranged on the right side of the left big arm model; and the first connecting disk is arranged on the right side of the left big arm model, and the first connecting disk is arranged on the right side of the left big arm model; and the first connecting disk is arranged on the right side of the left big arm model; The side of the first connecting disk away from the left big arm model is provided with a first connecting insert column, and the first connecting insert column is rotatably interspersed and connected with the left side of the model chest.

5. A quick pre-assembled model product according to claim 1, characterized in that the right arm model comprises:

A right big arm model, a left side of which is used for connecting a second round rod connecting mechanism, and a right chimney model is provided on a right side of the right big arm model;

A right forearm model, a top portion of the right forearm model hinged with a bottom portion of the right big arm model; The rotation angle of the right forearm model and the right big arm model is 0° to 150°.

6. A quick pre-assembled model product according to claim 5, wherein the second round rod connecting mechanism includes a second connecting disk, and the second connecting disk is disposed on the left side of the right big arm model; The side of the second connecting disk away from the right big arm model is provided with a second connecting insert column, and the second connecting insert column is rotatably interspersed and connected with the right side of the model chest.

7. A quick pre-assembled model product according to claim 1, characterized in that the left leg model comprises:

A left thigh model, wherein the right side of the top of the left thigh model is provided with a first ball-bowl sleeve for connecting with the ball-head connecting mechanism at the left side of the bottom of the waist and abdomen of the model;

A left calf model, a top portion of the left calf model hinged with a bottom portion of the left thigh model; The angle of rotation of the left calf model and the left thigh model along the horizontal longitudinal direction ranges from −90° to 90°, the angle of rotation of the left calf model and the left thigh model along the horizontal longitudinal direction is from −90° to 90°;

A left foot model, the left foot model is sleeved at the bottom of the left calf model, and the left foot model and the left calf model have a horizontal and horizontal rotation angle ranging from −70° to 70°; The top of the left foot model is hinged with a left foot collar, and the rotation angle of the left foot collar in the vertical direction is 0° to 30°.

8. A quick pre-assembled model product according to claim 1, characterized in that the right leg model comprises:

A right thigh model, the left side of the top of the right thigh model is provided with a second ball-bowl sleeve for connecting with the ball-head connecting mechanism at the right side of the bottom of the waist and abdomen of the model;

A right calf model, the top portion of the right calf model is hinged with the bottom portion of the right thigh model, and the angle of rotation of the right calf model and the right thigh model in the horizontal longitudinal direction ranges from −90° to 90°;

A right foot model, the right foot model is sleeved at the bottom of the right calf model, and the right foot model and the right calf model have a horizontal and transverse rotation angle range of −70° to 70°; The top of the right foot model is hinged with a right foot collar, and the rotation angle of the right foot collar in the vertical direction is 0° to 30°.

9. A quick pre-assembled model product according to claim 1, characterized in that, the ball-head connecting mechanism comprises:

A connecting hemisphere, the top of which is provided with a connecting pile, and the connecting pile is used for fixing the ball-head connecting mechanism with other components; One side of the middle part of the connecting hemisphere is provided with a splicing post, one side of the bottom part of the connecting pile is provided with a connecting port, and the inner wall of the top end of the connecting port is provided with an elastic plate;

An assembly hemisphere, one side of the assembly hemisphere is provided with a splicing groove, and the splicing column is interspersed and connected with the splicing groove; The top of the assembly hemisphere is provided with an assembly column, the assembly column is arranged in the connection port, and the top end of the assembly column is provided with a placement groove; The elastic plate is interspersed and connected in the placement groove.

* * * * *